343-756 SR
12/13/77 OR 4,063,249

United States Patent [19]
Bergander et al.

[11] 4,063,249
[45] Dec. 13, 1977

[54] SMALL BROADBAND ANTENNA HAVING POLARIZATION SENSITIVE REFLECTOR SYSTEM

[75] Inventors: Armin Bergander, Ay, Iller; Georg Kurz, Ulm, Danube, both of Germany

[73] Assignee: Licentia Patent-Verwaltungs-G.m.b.H., Frankfurt am Main, Germany

[21] Appl. No.: 633,023

[22] Filed: Nov. 17, 1975

[30] Foreign Application Priority Data

Nov. 16, 1974 Germany ..... 2454401

[51] Int. Cl.[2] ..... H01Q 11/10; H01Q 15/24
[52] U.S. Cl. ..... 343/756; 343/792.5; 343/837
[58] Field of Search ..... 343/756, 792.5, 818, 343/837, 838

[56] References Cited

U.S. PATENT DOCUMENTS

| | | | |
|---|---|---|---|
| 2,680,810 | 6/1954 | Korman | 343/839 |
| 2,991,473 | 7/1961 | Van Staaden | 343/761 |
| 3,745,585 | 7/1973 | Barbano | 343/837 |

FOREIGN PATENT DOCUMENTS

| | | | |
|---|---|---|---|
| 758,957 | 10/1956 | United Kingdom | 343/756 |

*Primary Examiner*—Eli Lieberman
*Attorney, Agent, or Firm*—Spencer & Kaye

[57] ABSTRACT

A broadband antenna system of small dimensions and composed of at least one antenna having an associated design operating frequency, and a plurality of reflectors operatively associated with the antenna and disposed at respectively different distances therefrom, each reflector being spaced from the antenna and having a reflection characteristic to be optimally matched with the antenna for operation at a respective partial frequency band, each reflector being associated with a different partial band such that the total operating frequency range of the system is divided into a plurality of partial bands equal in number to the number of reflectors and covering the design operating frequency range and a further frequency range below the lower limit of the design range, whereby the antenna characteristics are improved, and in particular the operative bandwidth of the system is increased in the low frequency direction.

10 Claims, 7 Drawing Figures

SMALL BROADBAND ANTENNA HAVING POLARIZATION SENSITIVE REFLECTOR SYSTEM

BACKGROUND OF THE INVENTION

The present invention relates to a broadband antenna of small dimensions composed of one antenna, or a plurality of individual antennas which are combined in a summing manner and which have any desired polarization, which may be a frequency dependent polarization.

It is known that antennas do not provide sufficient gain outside of their actual operating frequency range and particularly below their so-called limit frequencies.

It is also known that one antenna—which possibly includes a reflector—which is horizontally polarized, for example, will be influenced only slightly by a second antenna which is polarized perpendicularly to the first antenna and which is placed in front of the first antenna. In this case, it is insignificant whether the operating frequency ranges of the two antennas are the same or are different from one another. This effect, which is called polarization decoupling, is utilized, inter alia, in the radar art to produce two patterns which are independent of one another as a result of their different polarizations in that a reflector which is effective for only one given polarization is placed in front of the main reflector of a reflector unit.

It is also known that some broadband antennas, which are designed for certain types of polarization such as for linear polarization, for example logarithmic-periodic antennas which are vertically polarized in their operating frequency range, radiate and receive below the lower limit frequency of their operating frequency range, predominantly in counterpolarization, i.e., in the above example in horizontal polarization. This basically undesirable effect is utilized to advantage in the antenna of the present invention.

SUMMARY OF THE INVENTION

It is an object of the present invention to widen the bandwidth and to increase the gain of individual directional antennas or directional antennas which are formed by combining a plurality of individual antennas.

This and other objects are accomplished according to the present invention in that: the antenna characteristics are improved, and particularly the bandwidth is expanded in the direction toward lower frequencies, by providing two or more reflectors for each individual antenna and placing the reflectors at respectively different distances from that antenna; the total frequency band of the antenna, including the operating frequency range and the frequency band below the lower limit frequency of the operating frequency range which can be covered by the antenna, is divided into as many partial bands, which overlap if necessary, as there are reflectors; each reflector has its distance from the antenna and the frequency dependence of its reflection factor matched to a different partial band in an optimum manner, the reflector closest to the antenna being matched to the partial band having the highest frequencies and the reflector furthest from the antenna being matched to the partial band having the lowest frequencies, and each reflector which is most remote from its individual antenna is either polarization selective or is not polarization selective, whereas all other reflectors are preferably polarization selective.

The particular advantage of the antenna according to the invention is that in spite of its wide bandwidth it has compact dimensions. Additionally the mirror-image arrangement of such antennas permits the creation of defined polarizations in a very simple manner.

According to an advantageous embodiment, the dimensions of the individual reflectors of an individual antenna are made to increase from the reflector closest to the antenna to the reflector most remote from the antenna.

It is advantageous to arrange the reflectors of each individual antenna behind the other and to give them respectively different polarizations.

Advisably the polarization of each reflector is selected to correspond to the polarization of the associated individual antenna at the frequencies to which this reflector is tuned.

When but two reflectors are used for each individual antenna, the distance and polarization of the reflector closer to the antenna are tuned in an optimum manner with regard to the frequency range and the polarization at the operating frequency range of the associated individual antenna, and the reflector more remote from the antenna is matched in distance and polarization in an optimum manner to the frequencies and polarization in the frequency range below the operating frequency range of the individual antenna.

With the predominantly vertical or horizontal polarization of the individual antenna in the operating frequency range, the reflector closest to the antenna is preferably composed of vertically or horizontally, respectively, oriented parallel wires and the reflector remote from the antenna is composed of horizontally or vertically, respectively, oriented parallel wires or a metal plate.

In order to produce defined polarizations, mirror-image identical individual antennas are arranged in mirror symmetry to one another.

In order to improve the antenna characteristics, and particularly to broaden the bandwidth, dielectric and/or magnetic materials are introduced between the individual antennas and the reflectors.

The individual antennas are preferably logarithmic-periodic antennas.

DESCRIPTION OF THE PRFERRED EMBODIMENTS

Figure 1:
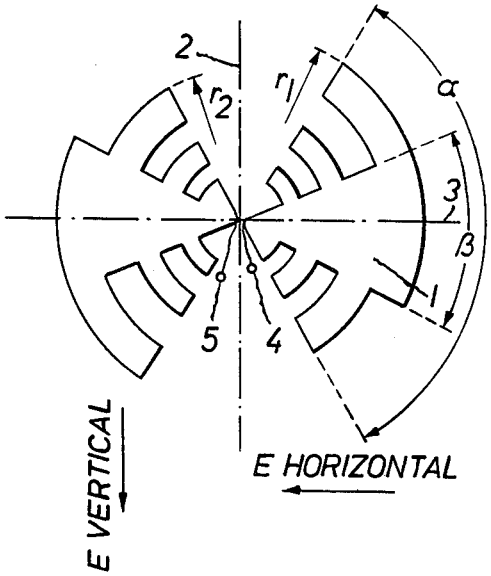
FIG. 1 is a front view of a logarithmic-periodic antenna.

FIG. 1 shows a two-section logarithmic-periodic antenna 1 which is oriented so that the median line 3 of each section is horizontal and the two sections are disposed symmetrically to one another with respect to a vertical line 2. Electrical connection to the antenna is through terminals 4 and 5 and from this antenna an embodiment of the invention can be produced by the addition of reflectors, the antenna then being usable either in its planar form shown in FIG. 1, i.e., with both antenna sections in the same plane, or in a form in which the two sections are pivoted about axis 2 to be at an angle to one another. In this configuration, one or both of the antenna sections would be inclined to the plane of FIG. 1. The directions of the field intensity vectors E vertical and E horizontal are indicated by arrows and it is intended to indicate that this antenna is polarized predominantly vertically in the upper frequency band, i.e., in the actual design operating frequency range, and predominantly horizontally in the lower frequency band, i.e., at frequencies below the lower limit frequency of the design operating frequency range, at which the antenna acts as a simple dipole.

Figure 1A:
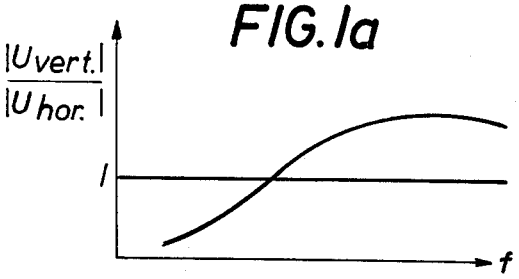
FIG. 1*a* is a curve of the relationship of the voltages $U_{vertical}/U_{horizontal}$ of the antenna of FIG. 1 as a function of frequency.

This is also shown in FIG. 1*a* which shows the relationship of the absolute values of $U_{vertical}/U_{horizontal}$ as a function of frequency *f*, $U_{vertical}$ and $U_{horizontal}$ being voltages induced in the antenna by the vertical or horizontal components, respectively, of the electric field intensity of a circularly polarized electromagnetic wave incident in a direction perpendicular to the plane of FIG. 1.

Figure 2:
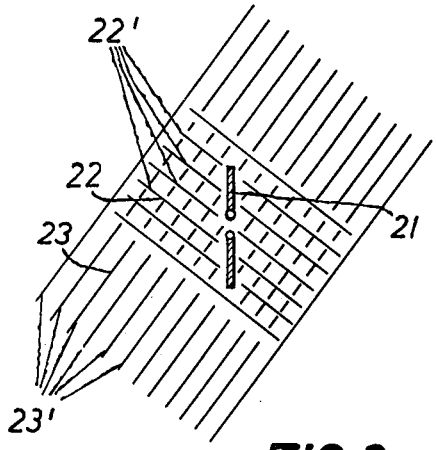
FIG. 2 is a front view of an embodiment of the present invention utilizing simple dipole antennas as the individual antennas.

In order to indicate that the principle of the invention is also applicable to other than logarithmic-periodic antennas, the embodiment of the invention shown in FIG. 2 utilizes a simple dipole antenna 21. This emdodiment is completed by two reflectors 22 and 23 located at respectively different distances behind the dipole antenna, with respect to the plane of FIG. 2. Both reflectors are polarization selective and their polarization directions are perpendicular to one another since the reflectors consist of parallel wires 22′ and 23′, respectively, which are oriented perpendicularly to one another. The reflector 22 closer to the antenna is tuned to the upper half of the operating frequency range of the dipole. Therefore, its dimensions are smaller than those of the reflector 23 which is more remote from the antenna and which is provided for the lower half of the operating frequency range, and thus for the low frequencies.

If the dipole antenna 21 of FIG. 2 is replaced by the logarithmic-periodic antenna shown in FIG. 1 so that the median line, or axis, 3 of that antenna is oriented parallel to the wires 23′, and if the distance of reflector 22, which is closest to the antenna, from the antenna is tuned in an optimum manner to the upper frequency band, i.e., the actual design operating frequency range of the antenna, and the reflector 23 more remote from the antenna is placed at an optimum distance for the lower frequency band, i.e., frequencies below the design frequency range, the antenna has a favorable gain in both frequency bands as well as a good receiving/transmitting ratio and favorable radiation patterns.

Figure 3:
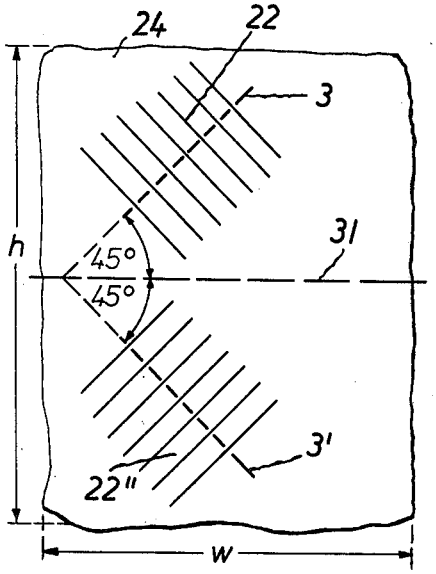
FIG. 3 is a front view of a very advantageous embodiment of the antenna of the invention.

A further particularly advantageous embodiment of the antenna of the invention will be described below with the aid of FIG. 3 in which a first logarithmic-periodic antenna 1 having the form shown in FIG. 1, only axis 3 of the antenna being shown in FIG. 3, is provided with a reflector 22 closer to the antenna of the type and orientation described above for reflector 22 of FIG. 2, and with a reflector 24 which is more remote from the antenna and which is composed of a metal plate constituting a form of non-polarization selective reflector. The first antenna is supplemented by a second identical antenna which is its mirror image with respect to its function, arrangement and structure, only axis 3′ of this antenna, which corresponds to axis 3, is shown in FIG. 3. The second antenna is provided with a closer reflector 22″ whose orientation relative to its associated antenna is the same as that of reflector 22 with respect to its antenna. Reflector 24 remote from the antenna is common to both antennas. The planes of both antennas are parallel to the planes of the reflectors. Axes 3 and 3′ are preferably both inclined at 45° to a horizontal reflection plane 31 perpendicular with respect to the plane of FIG. 3 so that the two antennas are oriented perpendicularly to one another.

If the antennas are connected together in a hybrid coupler, i.e., a component with decoupling properties which generally serves to combine or divide in amplitude and phase voltages of the same frequency, and thus acts as a sort of energy divider, the electromagnetic waves which are emitted perpendicularly to the plane of FIG. 3 and in the reflecting plane 31 are polarized either purely vertically or purely horizontally depending on whether the two antennas are fed through a summing input of the hybrid or through a difference input of the hybrid and independently of whether the two antennas are operated in the upper frequency band, i.e., in the design operating frequency range, or in the lower frequency band, i.e., at frequencies below the lower limit frequency of the operating frequency range, and thus independently of whether the antennas are polarized predominantly vertically or horizontally in the respective frequency range.

By connecting a phase shifting member between the hybrid coupler and one of the two antennas, circularly polarized electromagnetic waves can be emitted which rotate to the left if the antennas are fed through the summing input of the hybrid coupler and rotate to the right if feeding occurs through the difference input. Conversely, if the antenna is used as a receiving or ranging antenna, respectively, it is possible to separately receive the vertical and the horizontal components of a signal of any desired polarization which is incident in the plane of reflection.

Figure 4:
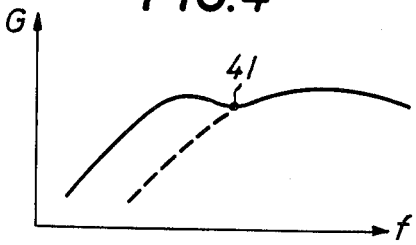
FIG. 4 is a graph comparing the antenna gain as a function of frequency for an antenna having only one reflector per individual antenna and having two reflectors per individual antenna.

FIG. 4 shows the gain G of an antenna arrangement according to FIG. 3 as a function of frequency, *f*. The portion of the curve shown in dashed lines is obtained when only one reflector per antenna is used, i.e., either the remote reflector 23 or the pair of reflectors 22 and 22′ close to the antenna. The use of a second reflector as provided by the invention substantially improves the antenna gain at low frequencies and thus broadens the bandwidth of the antenna toward low frequencies, yielding the solid line curve characteristic to the left of point 41. The curve portion to the right of point 41 is obtained with both one-reflector and two-reflector arrangements.

The arrangement according to FIG. 3 provides approximately the same gain for vertically and horizontally polarized electromagnetic waves which are incident in a direction perpendicular to the plane of that Figure.

Typical dimensions for two logarithmic-periodic antennas and two reflectors as shown in FIG. 3 are:

1. maximal radius $r_1$ of an antenna as shown in FIG. 1 is $r_1 = 0.4 \cdot \lambda_u$ with $\lambda_u$ = free space wavelength at the upper end of the operating frequency range of the antenna, the scale factor being $\tau = r_2/r_1 = 0.76$, $\alpha = 70°$ and $\beta = 20°$.,
2. the antenna is preferably used in the UHF-region and the highest and the lowest frequency of the operating frequency range have a ratio of 5:1,
3. the distance between the reflector 22 and the antenna equals $0.33 \cdot \lambda_u$ and the distance between the reflector 24 and the antenna is $0.83\ \lambda_u$,
4. the size of the reflector 22 is preferably $1.2 \cdot \lambda_u$ in width ($w$) and $1.83 \cdot \lambda_u$ in height ($h$) (approximately); the wires of the reflector are $0.005 \cdot \lambda_u$ in diameter and there is a distance of $0.033 \cdot \lambda_u$ between the wires; if there is an etched structure used instead of wires the paths are $0.013 \cdot \lambda_u$ by $0.00012 \cdot \lambda_u$ and the distance between the paths is $0.05 \cdot \lambda_u$; the reflector 24 preferably consisting of an aluminum-sheet has a width ($w$) of $1.67 \cdot \lambda_u$ and a height ($h$) of $2.67 \cdot \lambda_u$ (both approximately),
5. the effective frequency range associated with the reflector 22 is approximately 0.38 to 1 times $f_u$ ($f_u$ = frequency at the upper end of the operating frequency range) and that with the reflector 24 is approximately 0.2 to 0.45 times $f_u$,
6. the number of reflectors depends on the type of antenna and its frequency range; in most cases the optimal number will be 2 or in some cases 3 (for larger antenna arrays two reflectors will be advantageous),
7. in the case with two reflectors and a ratio of 5:1 respectively 4:1 between the upper and the lowest frequency of the operating range the distances between the reflectors and the antenna preferably have a relation of 2:5 respectively 1:2 (both approximately).

Figure 6:
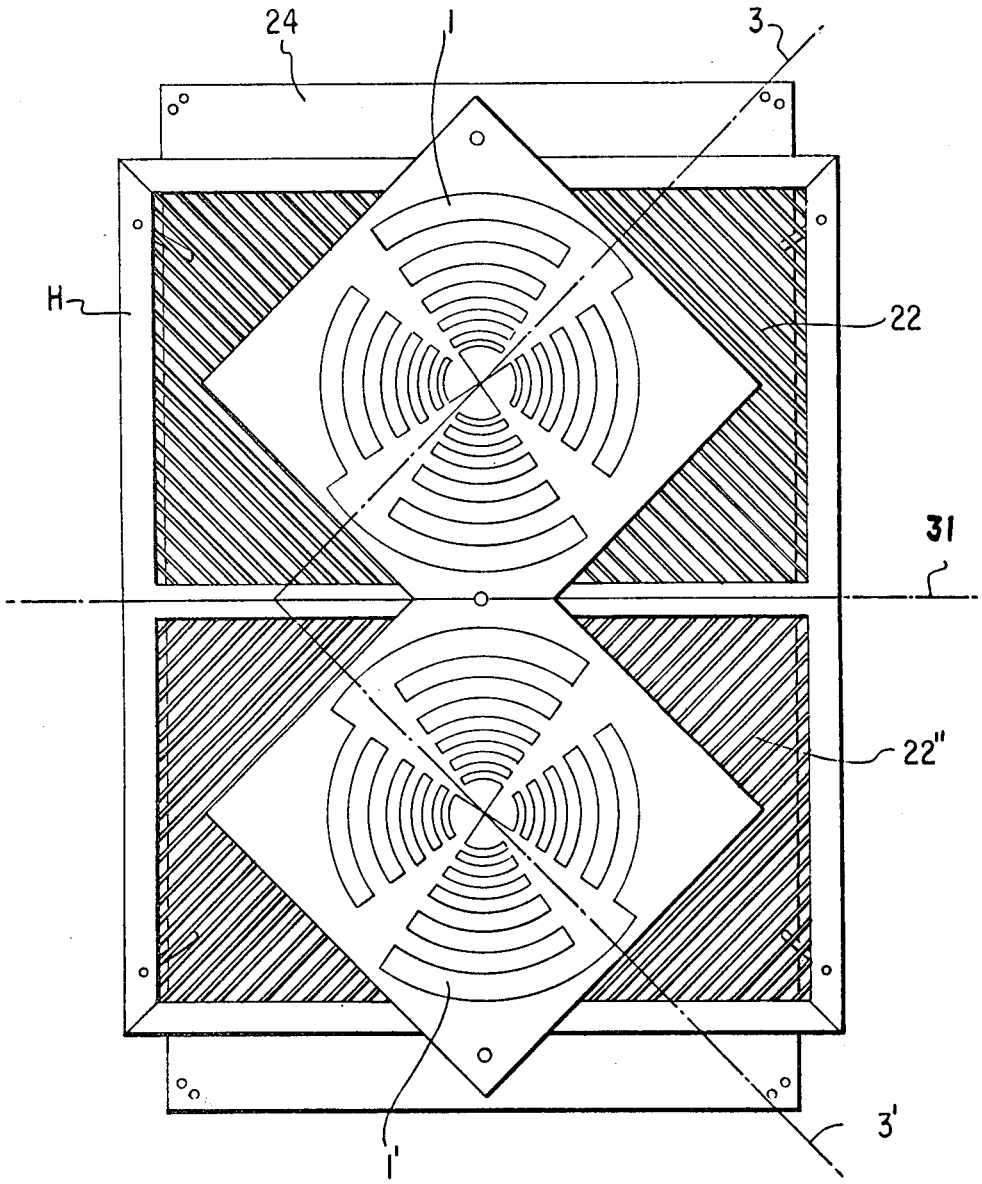
FIG. 6 is a front elevational view of a working embodiment of an antenna system according to the invention.

One practical example of the embodiment of FIG. 3 is shown in FIG. 6 and is composed of two logarithmic-periodic antennas 1 and 1' each having an asymmetrical radition pattern. Each of these individual antennas has an asymmetrical radiation pattern with respect to its respective axis 3 or 3'. The antennas 1 and 1' are constructed to be mirror images of one another and are arranged in mirror symmetry to one another with respect to the plane 31. Axes 3 and 3' are perpendicular to one another. Antennas 1 and 1' are mounted in front of a pair of reflectors 22 and 22" each composed of a plurality of parallel wires held in a frame H. Both reflectors are polarization selective and their polarization directions are perpendicular to one another since the wires of reflector 22 are perpendicular to those of reflector 22". Behind reflectors 22 and 22", i.e., further away from antennas 1 and 1', is a further reflector 24 composed of a metal plate constituting a form of non-polarization selective reflector.

Figure 5:
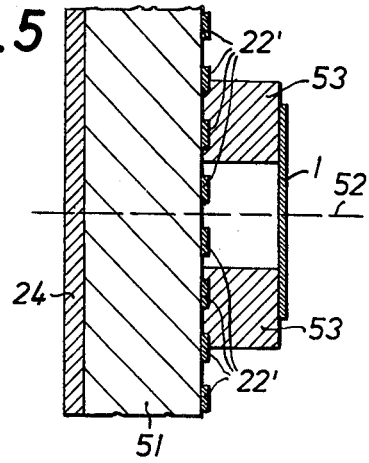
FIG. 5 is a side view of an embodiment of the present invention utilizing a logarithmic-periodic antenna having two reflectors and comprising dielectric or magnetic material disposed between the antenna and the two reflectors.

FIG. 5 shows a further embodiment of the antenna of the invention with a logarithmic-periodic antenna 1 as shown in FIG. 1 being provided with a closer reflector 22 as shown in FIG. 2 (only the wires 22' of the reflector 22 being shown in FIG. 5), with a more remote reflector 24 consisting of a metal plate as the non-polarisation selective reflector, with a dielectric or magnetic material 51 disposed between said reflectors and with a ring-shaped dielectric or magnetic insert 53 between antenna 1 and reflector 22. The radii of the dielectric or magnetic ring 53 should be about 0.5 times $r_1$ respectively about 1.2 times $r_1$ $r_1$ being shown in FIG. 1. This ring 53 improves the performance of said antenna at the lower frequency range of the reflector 22. For good efficiency the whole space between the two reflectors should be filled with a dielectric or magnetic insert having the size of the reflector 22 and the extension of which being perpendicular to an axis 52. Ceramics or other low loss dielectrics or ferrites may be used as inserts for broadening the bandwidth of the antenna without increasing its size.

It will be understood that the above description of the present invention is susceptible to various modifications, changes and adaptations, and the same are intended to be comprehended within the meaning and range of equivalents of the appended claims.

What is claimed is:

1. A broadband antenna system of small dimensions comprising: an antenna having a frequency dependent polarization characteristic and an associated design operating frequency range; and a plurality of reflectors operatively associated with said antenna and disposed at respectively different distances therefrom, each said reflector being spaced from said antenna and having a reflection characteristic to be optimally matched with said antenna in a manner to enable said system to be operative over a respective partial frequency band at least that reflector which is closest to said antenna being polarization selective, each said reflector being associated with a different respective partial band and having a polarization corresponding to the polarization of said antenna at frequencies within its respective associated partial band, at least one of said reflectors being associated with a partial band extending to a frequency below the lower limit of the design operating frequency range, such that the total operating frequency range of said system is divided into a plurality of partial bands equal in number to the number of said reflectors and covering the design operating frequency range and a further frequency range below the lower limit of the design operating frequency range; whereby the antenna characteristics are improved and particularly the operative bandwidth is enlarged in the low frequency direction.

2. An arrangement as defined in claim 1 wherein the dimensions of said reflectors increase from that reflector closest to said antenna to that reflector most remote from said antenna.

3. An arrangement as defined in claim 1 wherein said reflectors are arranged one behind the other and are arranged to act on radiation having respectively different polarization directions.

4. An arrangement as defined in claim 1 wherein there are only two said reflectors for said antenna, the distance and the polarization of that reflector closer to said antenna is matched in an optimum manner to the frequency range and polarization of the design operating frequency range of said antenna, and that reflector further from said antenna is matched in an optimum manner in its distance and polarization to the frequencies and the polarization of said antenna in a frequency range below the design operating frequency range of said antenna.

5. An arrangement as defined in claim 4 wherein that reflector closer to said antenna comprises a plurality of parallel wires oriented in the direction of polarization of said antenna with respect to frequencies in the design operating frequency range.

6. An arrangement as defined in claim 5 wherein that reflector further from said antenna comprises a plurality of parallel wires oriented in the direction of polarization of said antenna with respect to frequencies below the design operating frequency range.

7. An arrangement as defined in claim 5 wherein that reflector further from said antenna comprises a metal plate.

8. An arrangement as defined in claim 1 further comprising dielectric or magnetic material disposed between said antenna and said reflectors for improving the antenna characteristics and in particular for broadening the bandwidth of said system.

9. An arrangement as defined in claim 1 wherein said antenna is a logarithmic-periodic antenna.

10. A broadband antenna system of small dimensions comprising: two antennas each having an associated design operating frequency range and each having mirror-image identity to the other; and two pluralities of reflectors each operatively associated with a respective one of said antennas, said antennas and their associated reflectors being disposed in mirror symmetry to one another in order to obtain selected polarizations, each said reflector of each said plurality of reflectors being spaced from its respective antenna and having a reflection characteristic optimally matched with its respective antenna in a manner to enable said system to be operative over a respective partial frequency band, each said reflector of each said plurality being associated with a different respective partial band, at least one of said reflectors of each said plurality being associated with a partial band extending to a frequency below the lower limit of the design operating frequency range of its associated antenna, such that the total operating frequency of each said antenna and its associated plurality of reflectors is divided into a plurality of partial bands equal in number to the number of said reflectors in said plurality and covering the design operating frequency range and a further frequency range below the lower limit of the design operating frequency range of the associated antenna; whereby the characteristics of each said antenna are improved and particularly the operative bandwidth is enlarged in the low frequency direction.

* * * * *